United States Patent [19]

Braun

[11] Patent Number: 4,714,000

[45] Date of Patent: Dec. 22, 1987

[54] PICCOLO FLUTE

[76] Inventor: Anton J. Braun, Mainzer Strasse 21, 6073 Egelsbach, Fed. Rep. of Germany

[21] Appl. No.: 823,530

[22] Filed: Jan. 29, 1986

[30] Foreign Application Priority Data

Jan. 29, 1985 [DE] Fed. Rep. of Germany ..... 3502842

[51] Int. Cl.[4] ..... G10D 7/02
[52] U.S. Cl. ..... 84/384
[58] Field of Search ..... 84/380, 382, 384

[56] References Cited

U.S. PATENT DOCUMENTS 1,376,004 4/1921 Christensen ..... 84/384
3,890,874 6/1975 Vedder ..... 84/384

OTHER PUBLICATIONS

Benade, The Journal of The Acoustical Society of America, On Woodwind Instrument Bores, vol. 31, No. 2, Feb. 1959, pp. 137–146.

Nederveen, Acustica, Calculations on Locations and Dimensions of Holes in a Clarinet, vol. 14, No. 4, 1964, pp. 227–234.

*Primary Examiner*—L. T. Hix
*Assistant Examiner*—Brian W. Brown
*Attorney, Agent, or Firm*—Robert J. Koch

[57] ABSTRACT

A piccolo flute, in particular a piccolo transverse flute of the family of the "orchestra Boehm flutes", having a head part with a mouth hole, also called an embouchure hole, a closure cap with an adjustable seal on its free frontal end and a body part with finger holes and a key mechanism. The terminal finger hole is located on the free frontal end. The body part has only one C hole. The invention provides a novel hole setting scheme for a concert pitch tuning of a′=440 Hz. The axis of the C hole encloses with the longitudinal center plane of the body part containing the majority of the finger holes an angle of 120° to 130°.

8 Claims, 2 Drawing Figure

PICCOLO FLUTE

BACKGROUND OF THE INVENTION

1. Field of the Invention

The invention relates to a piccolo flute, in particular a piccolo transverse flute in the "orchestra Boehm flutes" family. The flute has a head with a mouth or embouchure hole, a closure cap with an adjustable seal on its free frontal side, and a body part with finger holes and a key mechanism. The terminal finger hole is located at the free frontal end.

2. Description of Related Art

Piccolo flutes obtain their absolute tuning based on a pitch one octave higher than the concert pitch a'. This is effected by varying the distance between the head part and the body part, where the head part is extracted from or inserted in the body part. Relative tuning is based on the absolute tuning, on a particular concert pitch a', and may only be used for the corresponding absolute tuning. Relative tuning is obtained by the distances of the finger holes and their combinations or hole setting scheme with a tolerance of +/−2 Hz.

The concert pitch is not defined uniformly in all countries. For this reason, different piccolo flutes are built.

There are two fundamental structural types of piccolo flutes; those with a closed G sharp key and those with an open G sharp key.

In both configurations the finger holes for the C tone are double holes located in succession in the axial direction of the body. These two finger holes are actuated by the thumb of the left hand by a key mechanism. The piccolo flute or piccolo transverse flute is played laterally and is therefore held transversely. For these reasons, the two C finger holes are located outside the row in which the majority of the finger holes is placed.

An angle $\beta$ between the axis of the row of finger holes in which most of the finger holes are located and the center axis of the two C finger holes is approximately 157°.

Parallel location of the axis of the C finger hole mechanism is especially important for uniform opening and closing of the two finger holes, but involves a great disadvantage. The angle of approximately 157° cannot be reduced and therefore condensate water easily finds an outlet through the two C finger holes and thereby interferes considerably with the acoustics of the instrument.

Ongoing experimentation and often decades of work by instrument makers has not resulted in improvements in the hole setting scheme to eliminate difficulties concerning their relative tuning. No ideal hole setting scheme with a desirable equalization of pitches over the entire pitch range of the instrument together with a ready response of the instrument has been found. In particular, the transition from one octave (register) to the other, especially in the difficult third octave, has not been obtained.

Numerous experiments were undertaken in the course of the last century to eliminate these shortcomings by means of theoretical calculations directed at producing an ideal hole setting scheme. It has not been possible, however, to arrive at piccolo flute configurations satisfactory in all of its aspects. In particular, it is noted in the case of known piccolo flutes that the octave between D1 and D2 is to broad and C sharp 1, C sharp 2, D3 (the third octave), F sharp 3 (G flat 3), G sharp 3 (A flat 3) and A sharp 3 (B flat 3) tend to a low tone or frequency, while the pitches F sharp 3 (G flat 3), G sharp 3 (A flat 3), A sharp 3 (B flat 3) and B flat 3 respond difficultly, in particular in the G sharp 3 (A flat 3) produced by the double C hole.

A special key mechanism is known to obtain an easier G sharp 3 response, but is has the disadvantage of higher cost and increased vulnerability of the instrument to mechanical failure.

The above-mentioned difficulties in known piccolo flutes, as they relate to tuning and pitch response, force flutists to engage in extremely time consuming practice. They must acquire a familiarity with the instrument enabling them to master an appropriate modification of the blowing process for the corrections required to obtain the purest possible pitch with the proper dynamics.

SUMMARY OF THE INVENTION

It is therefore an object of the invention to eliminate the aforementioned disadvantages of known piccolo flutes with simple and cost effective means. It is another object of the invention to design a piccolo flute of the afore-described type so that pure tuning with excellent tone equality or equalization in all three registers (octaves) is obtained. It is another object of the invention to provide an instrument with an easier and secure response particularly in the difficult third octave.

These objects are attained according to the invention in a surprisingly simple and economical manner. In contrast to the double C finger hole used heretofore, only one C finger hole is provided, together with an appropriate novel finger hole combination or setting scheme.

A single C finger hole makes it possible to provide a novel finger hole combination or hole setting scheme, where all of the existing disadvantages are eliminated, so that all of the tones over the entire pitch range of the instrument are of the same strength, equalization, purity and response and are entirely uniform with respect to quantity (volume) and quality, so that optimum use by the artist is possible.

The invention further provides the advantageous possibility of simplifying the key mechanism as the additional key mechanism for the pitch of G sharp 3 (A flat 3) is eliminated.

A further improvement is obtained by the existence of only a single C finger hole according to the invention, whereby a simple thumb mechanism may be employed. The axis of rotation of the opening and closing arm of the C finger hole key may now be set perpendicularly to the axial direction of the body part, in contrast to the parallel arrangement of the rotating axis of the closing arm of the double C finger hole key. According to the invention, the angle $\beta$ may be reduced to approximately 120° to 130°, preferably 125°. The undesirable flow of condensate water with its acoustical interference is thereby strongly restricted. Additionally, a large hole exhibits a reduced interference to the flow of condensate water compared to that of the two smaller holes. The disadvantageous acoustic problems are greatly reduced by this alone.

According to the invention, a hole setting scheme with one C finger hole and the following dimensions for a concert pitch a'=440 Hz with a closed G sharp configuration is proposed. In case of an open G sharp configuration the dimensions are the same for the concert pitch a', with the difference that the double G sharp (A flat) finger hole is eliminated and the G sharp (A flat) finger hole is located in the row of finger holes.

| Hole | I | II | III | IV |
|---|---|---|---|---|
| Mouth hole (Ab) | 0 | | | 8.5; 10.5* |
| D sharp (E flat) tr. | 95.20 | 0.43 | 64.80 | 4.20 |
| Dtr. | 107.20 | 0.48 | 52.80 | 4.20 |
| C sharp (D flat) | 111.30 | 0.50 | 48.50 | 3.80 |
| C | 127.80 | 0.58 | 32.20 | 5.70 |
| B | 137.50 | 0.62 | 22.50 | 5.70 |
| A sharp (B) | 148.00 | 0.66 | 12.00 | 5.70 |
| A | 160.00 | 0.73 | 0 | 6.10 |
| G sharp (A flat) dp | 1170.60 | 0.77 | 10.60 | 4.20 |
| G sharp (A flat) | 172.00 | 0.78 | 12.00 | 5.80 |
| G | 183.20 | 0.83 | 23.20 | 6.10 |
| F sharp (G flat) | 195.50 | 0.88 | 35.50 | 6.60 |
| F | 210.20 | 0.95 | 50.20 | 7.00 |
| E | 226.00 | 1.02 | 66.00 | 7.30 |
| D sharp (E flat) | 240.20 | 1.09 | 80.20 | 7.40 |
| D (terminal hole) | 265.20 | 1.20 | 105.50 | # |

In the above scheme:

I is the distance between centers of the mouth hole and finger hole for a'=440 Hz in mm.

II is the tolerance for a concert pitch tolerance of +/−2 Hz in mm, corresponding to a percentage of maximum +/−0.46 with respect to I.

III is the distance between centers of A finger hole and finger holes for a'=440 Hz in mm.

IV is the hole diameter in mm with a tolerance of +/−0.20 mm. Such a tolerance is necessary for technical reasons and is permissible without detrimental effects on tuning.

* is the magnitude of the two axes of the elliptical hole perpendicular to each other.

In the case of a cylindrical body part 11 mm and with a conical body part 9.60 mm.

The hole setting scheme is based on the concert pitch a', but is higher by one octave. As, however, the concert pitch is not uniform eveywhere as mentioned above, different piccolo flutes are built and derived from known hole setting schemes.

For a different frequency, I' of the concert pitch a'=440 Hz, the following known conversion formula is valid: I'(mm) (for a new frequency)=I(mm)×440 Hz/new frequency(Hz)

The invention is explained in more detail by means of a preferred embodiment, with a closed G sharp, shown in the drawings schematically only.

DETAILED DESCRIPTION OF THE PREFERRED EMBODIMENT

Figures 1, 2:
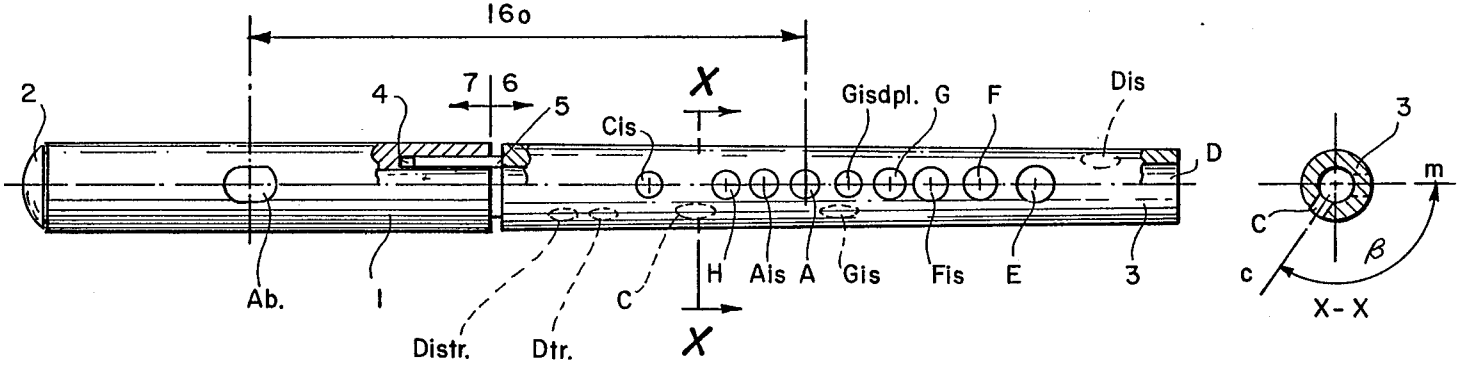
FIG. 1 shows a top view of a piccolo flute with the key mechanism removed.
FIG. 2 shows a section along line X—X according to FIG. 1.

The dimensions given in the table in Column I are theoretical values of the air column lengths without consideration of fine tuning.

The piccolo flute shown in FIG. 1 has two principal parts, i.e. the head part 1 with the closure 2 and the body part 3. In order to fine tune the absolute pitch, for example in view of varying temperatures, the head part 1 and the body part 3 are displaceable with respect to each other by means of sliding tubular pieces 4 and 5. To obtain a higher pitch, the distance between the mouth hole Ab and the finger hole is shortened by inserting the tubular pieces 4 and 5 into each other and vice versa, as indicated by the arrows 6 and 7.

The body part 3 of a piccolo flute shown in FIG. 1 is the closed G sharp key configuration; it has a wide G sharp or G sharp double (G sharp dpl.).

In an embodiment of the piccolo flute with an open G sharp key configuration the G sharp (A flat) dpl. hole is eliminated, whereby it becomes possible to locate the single G sharp hole in its place. The hole setting scheme according to the invention also includes such a feature.

It should be emphasized in this connection that the novel hole setting scheme according to the invention for piccolo flutes is highly suitable for embodiments of metal or wood, or wood combined with metal. Whether the head part extends cylindrically and the body part conically to deep D or deep C, or conversely, whether the head part is conical and the body part extends to deep D or C and is cylindrical are embodiments within the scope of the invention.

FIG. 2 shows a section X—X according to FIG. 1. The angle $\beta$ between the axis m of the finger holes and the axis r of the C finger hole is approximately 125°. In this manner a smaller angle than in the case of known flutes is obtained and the condensate water of the flutist is able to flow into the C finger hole with difficulty only.

I claim:

1. A piccolo transverse flute of the "Orchestra Boehm flutes" family comprising:

a head part with a mouth hole or embouchure hole and a closure cap with an adjustable seal on its free frontal side;

a body part with finger holes, said body part further comprising a hole setting scheme for a concert pitch a'=440 Hz wherein distances between the individual centers of finger holes from a center of a finger hole A in mm are approximately:

G sharp (A flat) dpl: 10.60
G sharp (A flat): 12.00
G: 23.20
F sharp (G flat): 35.50
F: 50.20
E: 66.00
D sharp (E flat): 80.20
D (terminal hole): 105.50
D sharp (E flat) tr.: 64.80
Dtr: 52.80
C sharp (D flat): 48.50
C: 32.20
B: 22.50
A sharp (B): 12.00 wherein a terminal finger hole is located on its free frontal side, and wherein the body part exhibits only one C hole (C).

2. A piccolo flute according to claim 1, wherein the holes exhibit approximate diameters of:

Mouth hole: 8.5 and 10.5 mm (oval)
D sharp (E flat) tr: 4.20 mm
Dtr.: 4.20 mm
C sharp (D flat): 3.80 mm
C: 5.50 mm
B: 5.70 mm
A sharp (B): 5.70 mm
A: 6.10 mm
G sharp (A flat) dpl: 4.20 mm
G sharp (A flat): 5.80 mm
G: 6.10 mm F sharp (G flat): 6.60 mm
F: 7.00 mm
E: 7.30 mm
D sharp (E flat): 7.40 mm
D (terminal hole):
11.00 mm (cylindrical body)
9.60 mm (conical body)
with a tolerance of +/−0.2 mm.

3. A Piccolo flute according to claim 2, wherein an axis (r) of the C hole encloses an angle of 120° to 130° with a longitudinal center plane (m) of the body part (3) containing the majority of the finger holes.

4. A Piccolo flute according to claim 2, wherein the finger holes are arranged accordingly to a hole setting scheme for tuning with a concert pitch corresponding to a different frequency, wherein the distances of the finger holes centers to the mouth or embouchure hole for the individual finger holes and for the terminal or outlet hole on the frontal side correspond to the product of the hole center distance to the mouth or embouchure hole valid for a concert pitch tuning a′=440 Hz and the ratio of 440 Hz to the said different frequency.

5. A Piccolo flute according to claim 4, wherein an axis (r) of the C hole encloses an angle of 120° to 130° with a longitudinal center plane (m) of the body part (3) containing the majority of the finger holes.

6. A Piccolo flute according to claim 1, wherein the finger holes are arranged according to a hole setting scheme for tuning with a concert pitch corresponding to a different frequency, wherein the distances of the finger hole centers to the mouth or embouchure hole for the individual finger holes and for the terminal or outlet hole on the frontal side correspond to the product of the hole center distance to the mouth or embouchure hole valid for a concert pitch tuning a′=440 Hz and the ratio of 440 Hz to the said different frequency.

7. A Piccolo flute according to claim 6, wherein an axis (r) of the C hole encloses an angle of 120° to 130° with a longitudinal center plane (m) of the body part (3) containing the majority of the finger holes.

8. A Piccolo flute according to claim 1, wherein an axis (r) of the C hole encloses an angle of 120° to 130° with a longitudinal center plane (m) of the body part (3) containing the majority of the finger holes.

* * * * *